United States Patent [19]

Boteler et al.

[11] 3,935,721

[45] Feb. 3, 1976

[54] TUBING BENDING MACHINE

[75] Inventors: Kenneth M. Boteler; Cecil E. Mayfield; Vivian C. Harris, all of Oklahoma City, Okla.

[73] Assignee: B & W Manufacturing Company, Inc., Oklahoma City, Okla.

[22] Filed: Feb. 28, 1975

[21] Appl. No.: 553,877

[52] U.S. Cl. ..... 72/22; 72/30; 72/32; 72/389; 72/441

[51] Int. Cl.[2] ..... B21D 7/24

[58] Field of Search ..... 72/22, 30, 32, 35, 36, 72/383, 385, 389, 386, 441, 461

[56] References Cited

UNITED STATES PATENTS

| | | | |
|---|---|---|---|
| 2,306,223 | 12/1942 | Parker | 72/22 |
| 2,440,599 | 4/1948 | Colwell | 72/389 |
| 2,456,675 | 12/1948 | Chaille | 72/22 |
| 2,525,403 | 10/1950 | Witt | 72/382 |
| 2,867,261 | 1/1959 | Traupmann | 72/389 |
| 3,388,574 | 6/1968 | Ignoffo | 72/389 |
| 3,429,157 | 2/1969 | Huth | 72/32 |
| 3,756,058 | 9/1973 | Hamkins | 72/389 |

*Primary Examiner*—C. W. Lanham
*Assistant Examiner*—Gene P. Crosby
*Attorney, Agent, or Firm*—William R. Laney

[57] ABSTRACT

A tubing bending machine is disclosed comprising a die and cooperating shoe means, means for advancing the die toward the shoe means to bend a pipe positioned therebetween, and a hydraulic piston and cylinder assembly coupled with the shoe means for restricting the movement of the shoe means during bending of the tubing, and for returning the shoe means to a pre-bending position. A linear scale is connected to a piston rod of the piston and cylinder assembly and movable therewith relative to the cylinder of the piston and cylinder assembly. A depth of bend indicator means is adjustably positionable along the linear scale to indicate a selected desired depth of bend reading thereon. Switch means is mounted on the machine in the path of movement of said depth of bend indicator means to be contacted by said depth of bend indicator means as it moves with said linear scale and piston rod of said piston and cylinder assembly during the bending of a tube.

9 Claims, 6 Drawing Figures

TUBING BENDING MACHINE

BACKGROUND OF THE INVENTION

1. Field of the Invention

This invention relates to machines for bending pipes, and more particularly, though not by way of limitation, to machines for automatically hydraulically bending a pipe or tubing to a preselected depth of bend followed by automatic termination of the bending action when the desired bend has been placed in the pipe.

2. Brief Description of the Prior Art

Many types of apparatus for bending cylindrical tubing into shapes suitable for use as tail pipes and mufflers on automobiles, as well as for various other uses, having previously been proposed, and many of these have been patented. In general, such machines employ a hydraulic piston and cylinder assembly to provide the power needed to bend the pipe, and operate on the principle of a die attached to such assembly and advanced against the pipe which is backed up by a pair of grooved shoes which are able to undergo an arcuate swinging movement as the hydraulically impelled die is forced against the pipe at a point where the center of the bend is to be made. As the piston of the piston and cylinder assembly is advanced, the pipe continues to undergo bending, and the shoes continue to swing outwardly. This bending movement is continued until the angle of the pipe which is thus formed has reached the desired magnitude. At this time, the actuation of the hydraulic cylinder is terminated, either by manual manipulation of a valve, or by automatic means which generally includes some type of switch which controls the status of the valve through which hydraulic fluid is passed to the hydraulic cylinder which drives the bending die. The automatic depth of bend control systems previously employed usually include some form of scale or indication device upon which an operator of the apparatus can pre-set a desired depth of bend, indicated in degrees or other indicia. The control mechanism has further included a limit switch system which permits movement of the shoes in their swinging arcuate movement to a certain point, at which point, a limit switch is contacted by a moving element of the assembly, and an electrical circuit is then altered in its status so as to interrupt flow of hydraulic fluid through a valve to the hydraulic cylinder. Further bending is thus automatically terminated at this time.

One of the most widely used types of depth of bend control systems which has been employed to permit an operator to automatically pre-select the degree of bend which he wishes to impart to a pipe has been a system which includes an arcuate protractor-type plate having indicia on the face thereof indicating the degrees which will be included in the angle of bend which the operator selects. A moving pointer is provided in association with this plate which can be moved to a location where the pointer points to, or indicates, the selected depth of bend, in degrees. This swinging pointer or arm generally has a frictional engagement to the plate or another part of the apparatus such that, once set, it will not vibrate from the set position. In some instances, a spring loading feature is incorporated in the depth of bend indicator system to bias the pointer or indicator arm to a selected position and retain it there against possible inadvertent movement. Associated with the indicator arm in such systems is frequently a limit switch which, no matter where the arm is moved, is interposed in the path of movement of some rigid structural element which is coupled or connected to the bending shoes in such a way that this element moves with the shoes during their movement, and in undergoing such movement, contacts the limit switch. At the time of contact with the limit switch, which time is determined by the setting on the indicator plate, an electrical circuit is either opened or closed in a way to cause closure of a valve admitting hydraulic fluid to the hydraulic piston and cylinder assembly used for bending the pipe. Bending is thus automatically terminated at the time that the rigid element coupled to the shoes contacts the limit switch whose position is pre-set by the elected positioning of the indicator arm.

Systems which include a swinging indicator arm and arcuate indicator plate of the type described have presented several disadvantages in usage. One of these disadvantages is that the indicator plate is frequently located in a position which is not readily accessible, and easily visible, to the operator, with the result that the operator must reach over certain parts of the pipe bending apparatus to reach the indicator arm and preset it to the selected position on the indicator plate. Moreover, the swinging action of the arm used to select the desired degree of bend, in conjunction with the spring loading of the arm or its frictional setting against displacement when once set, requires some muscular tension on the part of the operator setting the arm, and consequently, it is sometimes difficult for the operator, on the first attempt, to set the arm pointer at precisely the degree of bend which he wishes to indicate with an arm pointer -- that is, several swings in both directions past the scale reading may occur before he precisely centers the pointer at the right place on the scale.

Another aspect of the systems of the type described which is sometimes a disadvantage is the inability of either the limit switch, or the fixed element which contacts the limit switch, to yield in the event there is a malfunction in the electrical circuitry or the hydraulic system which results in a failure to inactivate the hydraulic system at a time when the limit switch is contacted by the fixed element. This results in either the limit switch being destroyed, or the fixed element being bent or distorted to where it becomes inoperative for future use.

A typical depth of bend control system of the sort previously employed is that which is illustrated and described in Ignoffo, U.S. Pat. No. 3,388,574. The Ignoffo patent includes the described arcuate indicator plate and swingable or movable arm carrying a pointer to indicate a particular degree reading on this plate representing the magnitude of the bend which it is desired to impart to a pipe being bent.

Other patents which show various types of pipe bending machines with swingable arms and arcuate scale plates included therein include Lance, U.S. Pat. No. 3,196,661 and Huth, U.S. Pat. No. 3,429,157. Various other types of systems and structures for controlling and indicating the depth of bend imparted to tubing being bent are described in Traupmann, U.S. Pat. No. 2,867,261; Brinkman, U.S. Pat. No. 2,056,155; Parker et al, U.S. Pat. No. 2,306,223; Chaille, U.S. Pat. No. 2,456,675; Dewitt, U.S. Pat. No. 2,525,403; Bos, U.S. Pat. No. 3,181,321 and Ballar, U.S. Pat. No. 2,357,873.

BRIEF DESCRIPTION OF THE PRESENT INVENTION

The present invention provides a very simple, mechanically sturdy and reliable depth of bend indicating system which can be used to automatically set into a pipe bending machine, a desired depth of bend to be imparted to a pipe. The system will reliably and repeatably cause the pipe to be bent through a precisely predetermined angle of bend, and will automatically arrest bending movement of the machine when this angle of bend has been imparted to the pipe.

Broadly described, the present invention is a tubing or pipe bending machine which comprises a die and cooperating shoe means, means for advancing the die toward the shoe means to bend a pipe positioned therebetween, and a hydraulic piston and cylinder assembly coupled with the shoe means for restricting the movement of the shoe means during bending of the tubing, and for returning the shoe means to a pre-bending position. The tubing bending machine further includes a linear scale which is connected to a piston rod of the piston and cylinder assembly, and is movable with such piston rod relative to the cylinder of this assembly. A depth of bend indicator means is adjustably positionable along the linear scale to indicate a selected desired depth of bend reading thereon, and switch means is mounted on the machine in the path of movement of the depth of bend indicator means so as to be contacted by the depth of bend indicator means as it moves with the linear scale and the piston rod of the piston and cylinder assembly during the bending of the tube. Conventional electrical circuitry is employed in conjunction with the switch means to operate a conventional valve which admits hydraulic fluid to a hydraulic cylinder utilized to reciprocate the die in the direction of the shoe means.

An object of the invention is to provide a simple and reliable depth of bend indicating device in a tubing bending machine so that an operator can easily and quickly pre-select a precise angle of bend to be imparted to a tubing or pipe to be bent by such machine.

Another object of the invention is to provide a tubing bending machine which functions effectively for bending a tubing to a desired angle, and which will not be damaged in the event of a malfunction of the electrical circuitry used for automatically stopping the bending motion of the machine at such time as the desired angle has been imparted to the pipe or tubing.

Another object of the invention is to provide a tubing bending machine having incorporated therein a depth of bend control system which can be easily utilized by an operator to set a pre-selected depth of bend into the apparatus for effecting such pre-selected bend in a tubing or pipe.

Additional objects and advantages of the invention will become apparent as the following detailed description of the invention is read in conjunction with the accompanying drawings which illustrate the invention.

BROAD DESCRIPTION OF THE DRAWINGS

DETAILED DESCRIPTION OF A PREFERRED EMBODIMENT OF THE INVENTION

Figure 1:
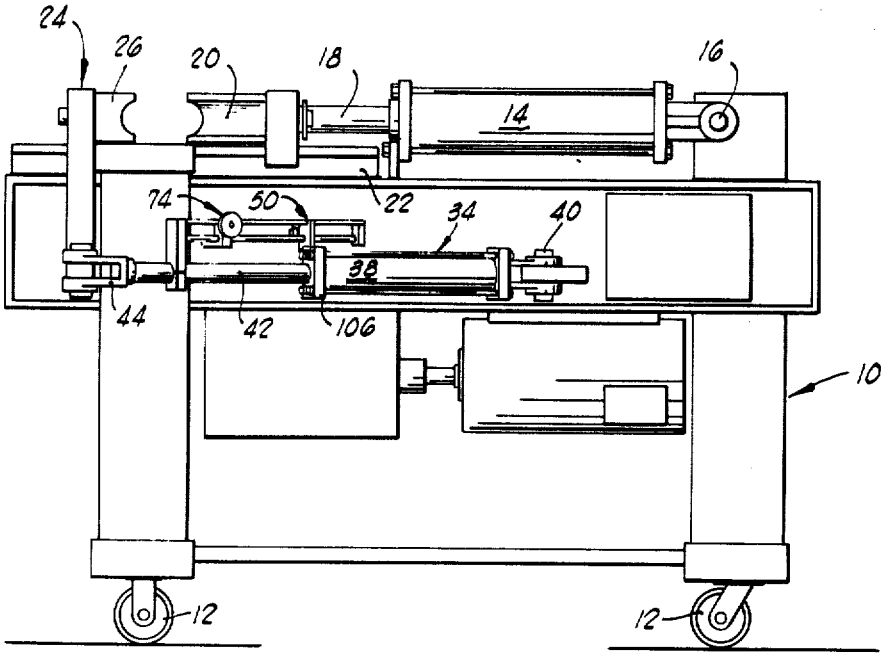
FIG. 1 is a side elevation view of a tubing bending machine constructed in accordance with the present invention.
Figure 2:
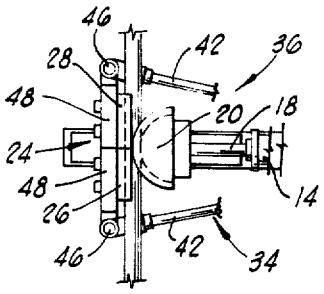
FIG. 2 is a plan view of a portion of the tubing bending machine of the invention as it appears prior to a tubing bending operation.

Referring initially to FIG. 1 in the drawings, the tubing bending machine of the invention includes a generally vertically extending framework designated generally by reference numeral 10, which framework is preferably mounted on a plurality of casters or rollers 12. At the upper side of the framework, a primary hydraulic bending cylinder 14 is disposed, and is pivotally connected at 16 to the framework 10. Projecting from the bending cylinder 14 is a piston rod 18 which carries at its outer end a die 20, which die is guided and supported by a track 22. The die 20 is of arcuate configuration as shown in FIG. 2 and the die is horizontally aligned with shoe means 24. The die carries a concave groove in its arcuate periphery or side facing the shoe means 24, to accommodate the cylindrical outer surface of a tubing or pipe during the bending action hereinafter described.

The shoe means 24 includes a pair of shoe blocks 26 and 28, which shoe blocks are of generally rectangular configuration, and are each provided with a concavity along the side thereof facing the die 20. The shoe blocks 26 and 28 are mounted for pivotation about vertical axes 30 and 32 so as to be able, when the die 20 is forced against a pipe having its outer peripheral surface contacting the concavity of the two shoe blocks, to swing outwardly to the position shown in FIG. 3.

Figure 3:
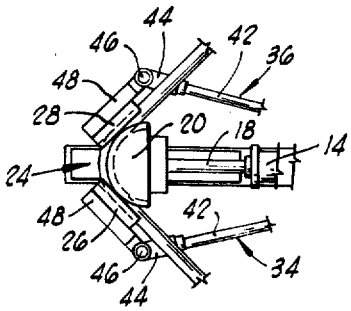
FIG. 3 is a plan view similar to FIG. 2, but illustrating the apparatus as it appears during a tubing bending operation.

Mounted on opposite sides of the framework 10 are a pair of auxiliary piston and cylinder assemblies designated generally by reference numerals 34 and 36. Each of the auxiliary piston and cylinder assemblies 34 and 36 includes a cylinder 38 which is pivotally connected at one end to a pivot post 40 attached to the side of the framework 10. Each of the assemblies 34 and 36 includes a piston rod 42 which projects out of the cylinder 38, and is connected through a clevis bracket 44 to a pivot post 46 carried on a wing member 48 connected to one of the respective shoe blocks 26 or 28 as shown in FIGS. 2 and 3. The auxiliary piston and cylinder assemblies 34 and 36 are identical in configuration, and in the way in which they are connected between the framework and the respective shoe block. As the shoe blocks 26 and 28 swing in the manner shown in FIG. 3 upon bending of the pipe, the piston rod 42 of each of the auxiliary piston and cylinder assemblies 34 and 36 is caused to retract into the respective cylinder 38, and on completion of the bend and return of the die 20 to its retracted position, the piston rods 42 are extended to force the shoe blocks 26 and 28 back to their aligned, non-bending positions as shown in FIG. 2.

Figure 4:
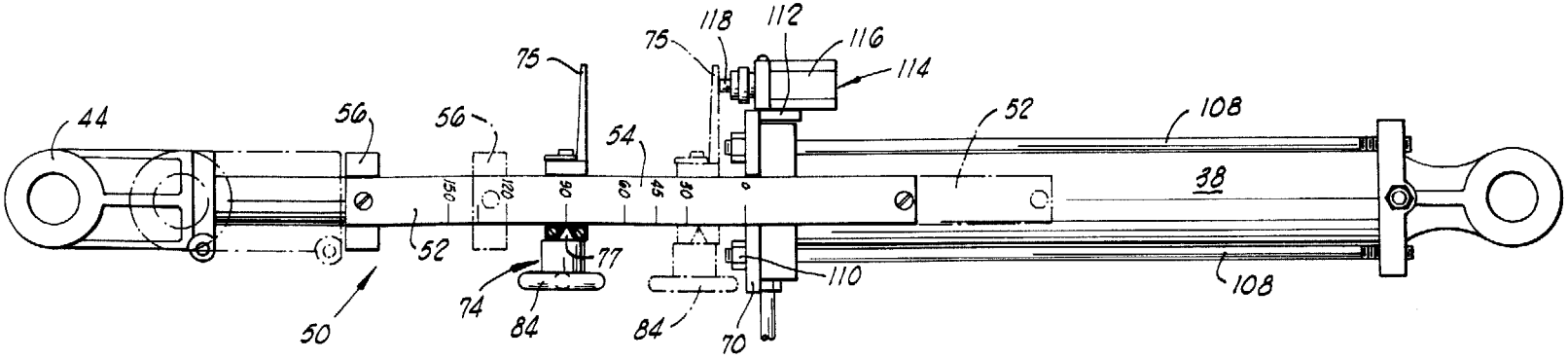
FIG. 4 is a plan view of a piston and cylinder assembly forming a portion of the tubing bending machine of the invention, and illustrating a linear scale and depth of bend indicator means employed in conjunction with the piston and cylinder assembly.

Referring to FIG. 4 of the drawings, the auxiliary piston and cylinder assembly 34 is provided with a depth of bend setting assembly 50 constructed in accordance with the present invention. The depth of bend setting assembly 50 includes an elongated linear scale 52 which carries over its length, numerical indicia or scale marks 54 indicative of the angular degrees through which a pipe will be bent when the depth of bend setting assembly 50 is used hereinafter described. The scale 52 has one of its ends secured to a vertical post 56 which carries, at its lower end, an arcuate recess or slot adapted to fit snugly around the upper side of the piston rod 42. The lower end of the vertical post 56 is also provided with threaded, bolt-receiving holes on opposite sides of the arcuate slot for receiving threaded bolts 60 used to retain a locking block 62 on the lower end of the post 56 and in frictional gripping engagement with the piston rod 42. When the locking block 60 is bolted in position, it cooperates with the arcuate slot in the post 56 for firmly gripping and engaging the piston rod 42 so that the post and scale 52 will move with the piston rod during its reciprocating movement.

At the end of the scale 52 opposite its end secured to the upper end of the post 56, the scale is secured by a suitable screw or other fastening member 61 to a vertical post 64 which is secured at its lower end to an elongated slide rod 66. The slide rod 66 is secured at its end opposite the end connected to the post 64 to the vertically extending post 56. Intermediate its length, the slide rod 66 extends slideable through a hub 68 which projects from one side of a vertically extending guide bracket 70 and through a slide block 72 forming a portion of a depth of bend indicator means designated generally by reference numeral 74. The slide block 72 has a contact plate 75 secured to one side of the slide block and projecting laterally therefrom in a direction substantially normal to the longitudinal axis of the slide rod 66.

Figure 6:
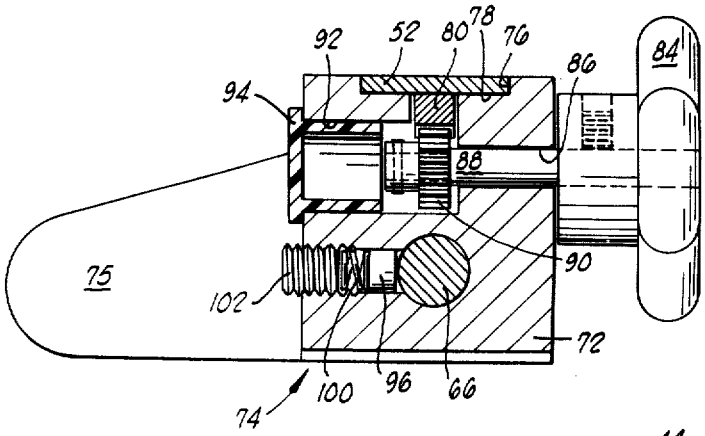
FIG. 6 is a sectional view taken along line 4—4 of FIG. 2.

The slide block 72 has a slot 76 formed in the upper side thereof which slidingly receives the elongated linear scale 52 as shown in FIG. 6. At one side of the upper surface of the slide block adjacent the scale 52, the slide block has formed thereon, pointer indicium 77 which points to the numerical indicia or scale marks 54 on the scale 52. The slide block 72 also has formed in the upper side thereof a counter slot 78 which projects downwardly into the slide block from the slot 76. The counter slot 78 slidingly accommodates an elongated toothed rack 80 which is mounted immediately beneath the elongated linear scale 52, and which has one of its ends secured to the vertical post 56 and its other end secured to the vertical post 64.

The depth of bend indicator means 74 further includes a handle 84 positioned alongside the slide block 72 and having projecting from one side thereof into a lateral counterbore 86 formed in the side of the slide block 72, an elongated shaft 88. At its inner end, the shaft 88 has keyed thereto a gear wheel 90 which drivingly meshes with the elongated toothed rack 80. The gear wheel 90 is positioned in the bottom of a large lateral bore 92 formed in the side of the slide block 72 on the opposite side thereof from the lateral counterbore 86, and in alignment with the lateral counterbore. The lateral bore 92 is closed by a suitable cap 94 which is pressed into the lateral bore. The bend indicator means 74 further includes a drag plug 96 which is positioned in the inner end of a small bore 98 drilled through the side of the slide block 72. The drag plug 96 is resiliently biased against the side of the elongated slide rod 66 by a spring 100 which is placed in compression by a screw plug 102 screwed into the bore 98, and is selectively adjusted in its position to adjust the frictional drag developed by contact of the drag plug 96 with the slide rod 66, and to exert a desired braking force.

The vertically extending guide bracket 70 is secured by any suitable means to the cylinder 38 at a location near one end thereof. In the illustrated embodiment of the invention, the guide bracket 70 is secured to a rectangular plate 106 which surrounds the cylinder 38 near one end thereof, and is retained in position by a plurality of brace rods 108. The ends of two of the brace rods 108 which are projected through the plate 106 are also projected through aligned apertures in the vertically extending guide bracket 70, and nuts 110 are used to secure the vertically extending guide bracket in position. The vertically extending guide bracket 70 is generally L-shaped in configuration and includes a flange 112 which extends substantially parallel to the longitudinal axis of the cylinder 38, and is displaced to one side thereof. The flange 112 has mounted thereon a microswitch assembly 114 which includes a microswitch housing 116 and a movable microswitch contact 118 which projects out of the housing in a direction substantially parallel to the direction of extension of the piston rod 42 from the cylinder 38.

Figure 5:
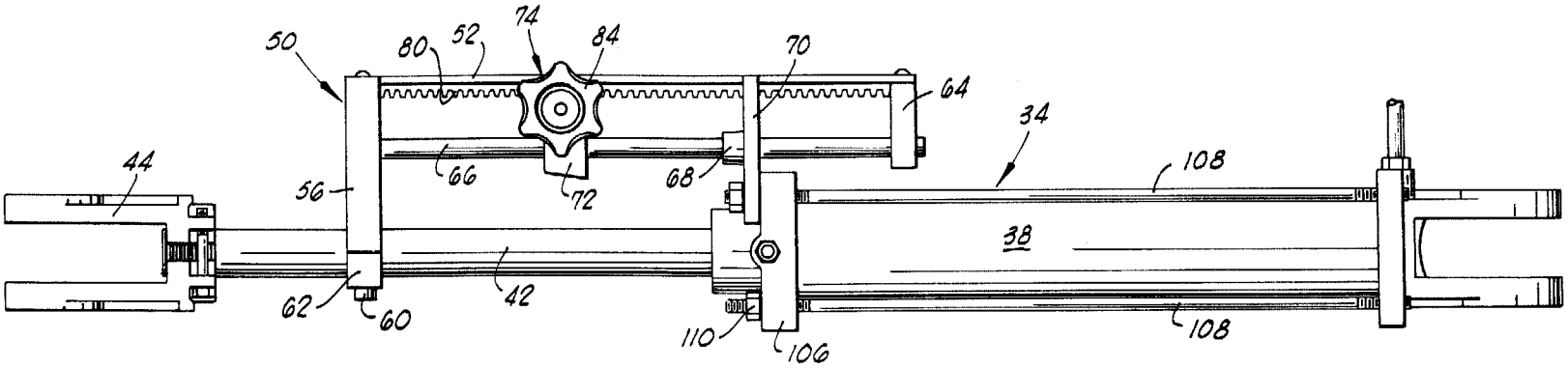
FIG. 5 is a side elevation view of the structure depicted in FIG. 2.

It will be noted in referring to FIG. 4 that the microswitch contact 118 is positioned in the path of movement of the contact plate 75 so that as this plate is reciprocated with the piston rod 42 during the retractive movement of the piston rod, and in a manner hereafter described in greater detail, the contact plate will contact the microswitch contact 118. It will also be noted in referring to FIG. 5 that the hub 68 projects from the central portion of the guide bracket 70 along the elongated slide rod 66 in the direction of the slide block 72, and that the hub projects in this direction beyond the ends of the brace rods 108 and the nuts 110 located thereon.

OPERATION

In operation of the tubing bending machine of the invention, the depth of bend setting assembly 50 is initially preset or adjusted to permit it to function in enabling a desired depth of bend to be pre-set into the apparatus, and to automatically control the extent to which a tubing or a pipe will be bent by the apparatus. In pre-setting the depth of bend setting assembly 50, the threaded bolts 60 are initially loosened slightly so that the vertical post 56 can be slidingly moved along the piston rod 42 to a position near the outer end of the piston rod adjacent the clevis bracket 44. The bolts 60 are then tightened when the post 56 has been located at a position such that a desired correlation has been established between the numerical indicia 54 on the scale 52 and the distance of retractive movement of the piston rod 42 into the cylinder 38, to the extent to which a pipe will be bent when placed between the die 20 and the shoe blocks 26 and 28. This relationship will be better understood from the following discussion.

In the bending of a tubing or pipe with the tubing bending machine of the invention, a tubing is initially placed in the concave recesses on the sides of the two shoe blocks 26 and 28 which face the die 20. A switch (not shown) is then thrown which opens a solenoid valve (not shown) admitting hydraulic fluid to the bending cylinder 14. This causes the piston rod 18 to be extended from the bending cylinder 14 to advance the die 20 fowards the shoe means 24. When the die 20 contacts the pipe positioned in the concave recesses in the facing sides of the shoe blocks 26 and 28, a bending force commences to be applied to the pipe. With the continued advance of the die 20, the pipe is bent in the general direction of conformity to the arcuate concave recess in the bending face of the die, and the shoe blocks 26 and 28 commence to undergo divergent pivotal movement as the die 20 is forced between them.

The swinging or pivotal movement of the shoe blocks 26 and 28 about their respective vertical axes of pivotation 30 and 32 causes the wing members 48 forming a portion of each of the auxiliary piston and cylinder assemblies 36, and connected to the shoe blocks for movement therewith, to undergo a similar and equal swinging or pivotal movement. The swinging movement of the wing members 48 causes the piston rods 42 to be forced into the respective cylinders 38 of each of the auxiliary piston and cylinder assemblies 36. There is, of course, a concurrent movement of the clevis brackets 44 in the direction of the cylinders 38. There is also a concurrent reciprocating movement in the direction of the cylinder 38 of the vertical post 56 forming a portion of the depth of bend setting assembly 50, since this post is rigidly secured to the piston rod 42 of the particular auxiliary piston and cylinder assembly 36 carrying the depth of bend setting assembly 50.

It may thus be seen that there is a direct relationship between the extent to which two blocks 26 and 28 are pivoted or swung outwardly apart from each other, and the distance which the vertical post 56 moves toward the cylinder 38. There is, therefore, also a direct relationship between the distance that the post 56 moves towards the cylinder 38, and the extent to which the pipe is bent or, stated differently, the angle of bend undergone by the pipe during the bending operation. Finally, it will be perceived that, since the linear scale 52 is secured to the post 56, and is movable in a reciprocating movement with this post, there is also a direct relationship between the distance that the scale is moved past the microswitch assembly 114, which is rigidly connected to the cylinder 38, and the degree to which the pipe is bent.

Prior to commencement of the bending of the pipe or tubing, an operator of the tubing bending machine has pre-set the depth of bend setting assembly 50 so as to interrupt or stop the advance of the die 20 from the bending cylinder 14 at a time when the pipe or tubing has been bent through the desired angle. This is accomplished by the operator turning the handle 84 so that the slide block 72 is moved up or down the linear scale 52 as the gear wheel 90 engages the teeth of the elongated toothed rack 80. As the slide block 72 is caused to move relative to the elongated linear scale 52 by the operator's rotation of the handle 84, the indicia pointer 77 at the upper side of the slide block 72 moves past the numerical indicia or scale marks 54 on the scale. The extent of compression of the spring 100 has previously been adjusted by adjusting the position of the screw plug 102, so that a slight drag is imposed on the movement of the slide block 72 along the elongated slide rod 66 just sufficient to prevent the slide block from moving due to vibratory forces or anything other than an intentional movement by rotation of the handle 84 by the operator.

In the manner described, the operator can quickly and easily set the indicia pointer 77 opposite, and in direct alignment with, a chosen numerical indicia or scale mark 54 corresponding to the degree of bend which he wishes to impart to the tubing being bent. In other words, the angle which is to be definitive of the bend formed in the tubing is indicated by one of the numerical indicia 54 on the scale 52, and it is to this particular indicia on the scale that the operator moves the indicia pointer 77 by rotating the handle 84 to cause the slide block 72 to move along the scale. When the desired value has been set by the operator in this manner, the slide block 72 will remain at the precise location to which it has been moved. It is important to note that no more muscular tension is required by the operator for moving the slide block by rotation of the handle 84 at the time that the rotation of the handle is first commenced, than is required in the course of rotation of the handle, nor is there any noticeable discontinuity in this muscular tension occurrent at the time that the rotative movement of the handle 84 is terminated as compared to the times when it is being rotated to move the slide block 72 to the selected position.

Setting of the slide block 72 in the manner described will establish a distance relationship between the contact plate 75 and the microswitch contact 118. This distance, as established by the setting of the slide block 72 along the scale 52, is directly related to the distance which the die 20 can be permitted to advance against the pipe in order to bend it to the extent desired. As the piston rod 18 carrying the die 20 continues to be extended from the bending cylinder 14, the shoe blocks 26 and 28 of the shoe means 24 are pivoted from the position shown in FIG. 2 of the drawings to the position shown in FIG. 3, and the pipe 25 is bent around the arcuate, concavely grooved surface of the die. It will be noted that this movement, as illustrated in its extremity in FIG. 3, causes the wing members 48 to pivot in a direction such that the piston rods 42 of the auxiliary piston and cylinder assembly 36 are caused to be retracted into their respective cylinders 38, and the contact plate 75 moves from the full line position shown in FIG. 4 of the drawings, where the bend indicator means 74 has been set to procure a bend of 90°, to the dashed line position where the contact plate contacts the microswitch contact 118 of the microswitch assembly 114.

The microswitch assembly 114 is connected in conventional circuitry which controls, through a solenoid valve, the introduction of hydraulic power fluid to the bending cylinder 14. When the microswitch in the microswitch assembly 114 and having the contact 118 is opened by contact therewith of the contact plate 74, the circuitry to the solenoid valve (not shown) admitting hydraulic power fluid to the bending cylinder 14 is opened, this valve closes, and no further extension of the piston rod 18 carrying the die 20 occurs. The bending action of the tubing bending machine is thus terminated at this point.

The electrical circuitry, including the solenoid valve interposed in the hydraulic fluid supply conduit to the bending cylinder 14, is of conventional and well known character, and is of the type disclosed and described in the Huth and Ignoffo patents previously referred to herein insofar as the bend interrupting functions here described are concerned.

In an alternative form of construction known to the prior art, the described electrical circuitry may further include means for automatically opening a valve to admit hydraulic fluid to the piston 38 of the auxiliary piston and cylinder assemblies 36 at the same instant that power fluid flow to the bending cylinder 14 is interrupted. Admission of hydraulic power fluid to the cylinders 38 of the auxiliary piston and cylinder assemblies 36 at the rear ends of these cylinders will then cause the piston rods 42 to be extended from the cylinders so that the shoe means 24 is returned to its prebending status as shown in FIG. 2 of the drawings. In another embodiment of such circuitry, automatic extension of the piston rods 42 from the cylinders 38 in the manner described is not effected, but instead, an operator must volitionally and manually close a switch to open the valve in the conduits delivering hydraulic fluid to the cylinders 38 so as to effect the return of the auxiliary piston and cylinder assemblies 36 to their prebending status. This arrangement has the merit of being safer to operate, in many instances, since there are some occasions when the automatic return to prebending status is not desirable, and is unsafe.

A feature of the present invention is the ability of the bend indicator means 74 to slide on the elongated slide rod 66 relative to the vertically extending guide bracket 70 and the piston rod 42 if a force acting along the piston rod is applied to the bend indicator means, and irrespective of whether, at the time of application of such force, the handle 84 is being rotated. The value of this feature is to prevent damage or structural malfunction to the depth of bend setting assembly 50 in the event there should be a failure of the electrical circuitry which includes a microswitch assembly 114 to effectively operate to interrupt flow of hydraulic power fluid to the bending cylinder 14 when the microswitch contact 118 is contacted by the contact plate 75.

Thus, as the elongated linear scale 52 and the bend indicator means 74, set at a preselected position therealong, reciprocate toward the cylinder 38 to a point where the contact plate 75 contacts the microswitch contact 118, the slide block 72 is at the same time brought into contact with the hub 68 which projects along the elongated slide rod. If, at this time, the electrical circuitry malfunctions in failing to prevent further flow of hydraulic fluid to the bending cylinder 14, the piston rod 42 and the elongated linear scale 52 will continue to be moved toward the cylinder 38 as the bending motion is continued. At this time, the force exerted against the slide block 72 by the hub 68 will cause the bend indicator means to slide relatively to the elongated slide rod 66. Stated differently, the slide rod 66 can continue to slide through the slide block 72 at this time due to the ability of the gear wheel 90 to freely rotate as the elongated boothed rack 80 passes thereover, and due to the light frictional drag imposed by the drag plug 96 on the slide rod 66 which, at this time, is overcome to permit the described sliding movement. The capability of the bend indicator means 74 to slide relative to the moving slide rod 66 at this time prevents damage to the rack 80 and gear wheel 90, and also prevents the contact plate 75 from being bent or broken. The physical integrity of the microswitch assembly 114 is also maintained, since the pressure brought to bear against this assembly by the contact plate 75 will not be so great, before sliding movement of the bend indicator means commences, that the microswitch assembly will be bent or damaged.

From the foregoing description of the invention, it will be apparent that the tubing bending apparatus of the invention provides a very easily employed depth of bend setting assembly which can be quickly and easily incorporated on many existing tubing bending machines. Moreover, the depth of bend setting assembly can be used without error by an unskilled operator with a minimum of very simple instructions. The depth of bend setting assembly is mounted in a position where it is relatively accessible, and always visible to the operator and, in the event of some chance malfunction of the control circuitry, is able to yield at structural locations such that no damage to the depth of bend setting assembly will occur.

Although a preferred embodiment of the invention has been herein described in order to provide a definitive example of the basic principles of the invention, it will be understood that some changes and structural modifications can be effected in the illustrated and described structure without departure from the basic principles of the invention. Changes and innovations of this type are therefore deemed to be circumscribed by the spirit and scope of the invention, except as the same may be limited by the appended claims or reasonable equivalents thereof.

What is claimed is:

1. A tubing bending machine comprising:

a die;

means for advancing the die;

shoe means positioned in the path of advance of the die and cooperating with the die to bend a length of tubing;

a hydraulic piston and cylinder assembly coupled with the shoe means for restricting the movement of the shoe means during bending of the tubing, and for returning the shoe means to a pre-bending position, said assembly including a cylinder and including a piston rod retractable and extensible as said shoe means undergoes movement during and after bending of the pipe;

a linear scale connected to said piston rod and movable therewith relative to the cylinder of the piston and cylinder assembly;

depth of bend indicator means adjustably positionable along the linear scale to indicate a selected desired depth of bend reading thereon; and switch means mounted on the machine in the path of movement of said depth of bend indicator means as it moves with said linear scale and piston rod.

2. A tubing bending machine as defined in claim 1 wherein said depth of bend indicator means comprises:

an elongated rod extending substantially parallel to said linear scale;

block means slidably mounted on said rod and carrying a pointer alignable with indicia on said scale;

an elongated toothed rack extending substantially parallel to said rod and scale; and gear means journalled in said block means and engaging said toothed rack.

3. A tubing bending machine as defined in claim 1 wherein said depth of bend indicator means comprises:

means carrying a pointer alignable with indicia on said scale and slidable along the length of said scale;

manually operable gear means mounted between said pointer carrying means and said scale for reciprocating said pointer carrying means along said scale; and rigid contact means connected to, and movable with, said pointer carrying means and positioned in alignment with said switch means for contact therewith when said pointer carrying means is reciprocated along said scale.

4. A tubing bending machine as defined in claim 1 wherein said switch means is mounted upon one end of said cylinder and offset from said piston rod and linear scale.

5. A tubing bending machine as defined in claim 2 wherein said block means comprises:

a slide block slidably mounted on said rod;

brake means frictionally resisting sliding movement of said slide block on said rod; and a contact plate connected to, and projecting from, said slide block in a direction substantially normal to said rod, and to a location facilitating contact with said switch means.

6. A tubing bending machine as defined in claim 5 wherein said switch means is mounted upon one end of said cylinder and offset from said piston rod and linear scale.

7. A tubing bending machine as defined in claim 6 wherein said machine further includes hub means around said rod adjacent said cylinder and facing toward said slide block for contacting said slide block and stopping further sliding movement thereof along said rod.

8. A tubing bending machine as defined in claim 7 and further characterized as including a vertically extending guide bracket mounted on said cylinder and having said hub secured to, and projecting from, one side thereof, and having said microswitch assembly mounted thereon.

9. A tubing bending machine as defined in claim 8 wherein said slide block has a lateral bore formed in one side thereof and extending substantially normal to said rod;

and wherein said brake means comprises:

a drag plug movably positioned in said lateral bore and frictionally engaging said rod;

a screw plug adjustably and threadedly engaged with said lateral bore; and a spring between said drag plug and said screw plug.

* * * * *